US009155336B2

(12) United States Patent
Liu

(10) Patent No.: US 9,155,336 B2
(45) Date of Patent: Oct. 13, 2015

(54) ELECTRONIC CIGARETTE AND ELECTRONIC CIGARETTE DEVICE

(75) Inventor: Qiuming Liu, Shenzhen (CN)

(73) Assignee: HUIZHOU KIMREE TECHNOLOGY CO., LTD., SHENZHEN BRANCH, Shenzhen, Guangdong Province (CN)

( * ) Notice: Subject to any disclaimer, the term of this patent is extended or adjusted under 35 U.S.C. 154(b) by 284 days.

(21) Appl. No.: 13/813,647

(22) PCT Filed: Jun. 16, 2012

(86) PCT No.: PCT/CN2012/077049

§ 371 (c)(1),
(2), (4) Date: Jan. 31, 2013

(87) PCT Pub. No.: WO2013/185357

PCT Pub. Date: Dec. 19, 2013

(65) Prior Publication Data

US 2013/0333711 A1 Dec. 19, 2013

(51) Int. Cl.
*A24F 47/00* (2006.01)

(52) U.S. Cl.
CPC ..... *A24F 47/002* (2013.01); *A24F 47/008* (2013.01)

(58) Field of Classification Search
CPC ..... A24F 47/008
See application file for complete search history.

(56) References Cited

U.S. PATENT DOCUMENTS

| | | | | |
|---|---|---|---|---|
| 5,146,390 | A * | 9/1992 | Wong | 361/825 |
| 2005/0007710 | A1* | 1/2005 | Chen et al. | 361/56 |
| 2009/0126745 | A1* | 5/2009 | Hon | 131/273 |
| 2009/0274192 | A1* | 11/2009 | Tseng | 374/170 |
| 2011/0265806 | A1* | 11/2011 | Alarcon et al. | 131/273 |
| 2012/0227753 | A1* | 9/2012 | Newton | 131/347 |
| 2013/0037041 | A1* | 2/2013 | Worm et al. | 131/329 |
| 2013/0228191 | A1* | 9/2013 | Newton | 131/329 |

FOREIGN PATENT DOCUMENTS

CN 101130121 A * 2/2008

OTHER PUBLICATIONS

CN 101130121 Translation; Wang, Zhiqun; Feb. 2008.*

* cited by examiner

*Primary Examiner* — Richard Crispino
*Assistant Examiner* — Eric Yaary
(74) *Attorney, Agent, or Firm* — Cheng-Ju Chiang

(57) ABSTRACT

This invention refers to an electronic cigarette and an electronic cigarette device. The electronic cigarette includes an outer shell defining a display window, and a thermometer module disposed on the outer shell; the thermometer module comprises a measuring unit, a display unit located within the outer shell and a circuit processing unit; the measuring unit gets a temperature data of an object to be measured or medium and transmits the temperature data to the circuit processing unit, and finally the circuit processing unit controls the display unit to display the temperature data. The measuring unit comprises a temperature sensing component located at an outer wall of the outer shell of the electronic cigarette and pins electrically connected the temperature sensing component to the circuit processing unit. The electronic cigarette has a function of sensing and measuring body temperature, or temperature of other objects or medium, such as the ambient temperature.

14 Claims, 11 Drawing Sheets

ELECTRONIC CIGARETTE AND ELECTRONIC CIGARETTE DEVICE

CROSS REFERENCE TO RELATED APPLICATIONS

The present application is a 35 U.S.C. §371 National Phase conversion of International (PCT) Patent Application No. PCT/CN2012/077049, filed on Jun. 16, 2012, the disclosure of which is incorporated by reference herein. The PCT International Patent Application was filed in Chinese.

TECHNICAL FIELD

This invention relates to fields of electronic cigarettes and cigarette casings, and particularly to an electronic cigarette device having a thermometer.

DESCRIPTION OF BACKGROUND

Currently electronic cigarettes capable of sensing and measuring body temperature have not yet appeared on the market, the existing electronic cigarettes include a sucking rod and a power rod, and the sucking rod includes: a sucking cylinder, a sucking nozzle, a liquid smoke cup used for storing liquid smoke, and an atomizing device fixed in the sucking cylinder and comprising individual atomizer and atomizing cup.

Existing electronic cigarettes have the following shortcomings: they not have the function of measuring body temperature or object temperature, or the ambient temperature; since the atomizing device is fixed to the sucking cylinder and can not be replaced, the atomizing device is disposable; the atomizing device adopts an individual atomizer, atomizing speed of the liquid smoke is slightly slower, and the amount of smoke is less; because the sucking nozzle and the liquid smoke cup are individually manufactured, the structure is more complex and production cost is higher.

SUMMARY

An object of the present invention is: to provide an electronic cigarette, which has a function of sensing and measuring body temperature, or temperature of other objects or medium, such as the ambient temperature.

Another object of the present invention is to provide an electronic cigarette, wherein the atomizing device in the electronic cigarette is easy to be disassembled and assembled, repaired or replaced, and can be reusable, to improve the atomizing speed of liquid smoke and the amount of smoke.

To achieve the above-mentioned objects, the present invention disclose an electronic cigarette, comprising: an outer shell, and further comprising a thermometer module disposed on the outer shell; wherein, the thermometer module comprises a measuring unit, a display unit and a circuit processing unit; and the measuring unit gets a temperature data of an object to be measured or medium and transmits the temperature data to the circuit processing unit, and finally the circuit processing unit controls the display unit to display the temperature data.

Furthermore, wherein, the measuring unit comprises a temperature sensing component and pins, the temperature sensing component is located at an outer wall of the outer shell of the electronic cigarette; the temperature sensing component is electrically connected with the circuit processing unit via the pins; the display unit is located within the outer shell of the electronic cigarette, and the outer shell correspondingly defines a display window; the display window is made of transparent or translucent material, or is an opening.

Furthermore, wherein, the electronic cigarette comprises a sucking rod and a power rod; and the thermometer module is configured at the outer shell of the sucking rod and/or the power rod.

Furthermore, wherein, the thermometer module further comprise a thermometer circuit board, the circuit processing unit is integrated onto the thermometer circuit board; the thermometer circuit board and the display unit are stacked together, and an insulating heat shield 75 is inserted therebetween.

Furthermore, wherein, the thermometer module is installed in the electronic cigarette by means of a support bracket; the support bracket comprises an upper plate, a lower plate and a side plate connecting the upper plate and the lower plate, a receiving chamber is surrounded by the upper plate, the lower plate and the side plate; the display window is configured at the side plate.

Furthermore, wherein, the thermometer module is mounted at a bottom of the power rod; the power rod is provided at its bottom with a bottom cap which is connected with the lower plate of the support bracket; the bottom cap defines a through hole; the thermometer sensing component is located at an outer side of the bottom cap, and the pins pass through the through hole and the lower plate of the support bracket and is fixed to the support bracket.

Furthermore, the electronic cigarette further comprises an atomizer control circuit board disposed in the outer shell, wherein the circuit processing unit is integrated onto the atomizer control circuit board.

Furthermore, wherein, the sucking rod comprises a sucking cylinder served as the outer shell, an atomizing device disposed in the sucking cylinder, a liquid smoke cup, a sucking nozzle configured at an end of the sucking cylinder, and wherein the atomizing device comprises an atomizing cup having an atomizing chamber, at least two atomizers fixed in the atomizing chamber, and oil-guiding component for guiding the liquid smoke within the liquid smoke cup into the atomizing cup.

Furthermore, wherein, the sucking cylinder is further provided with a connecting element for fixing the atomizing device into the sucking cylinder, the connecting element has a cylindrical structure, and comprises an upper portion, a middle portion and a lower portion which are in turn increased in outer diameter, the upper portion of the connecting element is inserted into the bottom the atomizing device and tightly fixed to the atomizing device to secure the atomizing device into the sucking cylinder, an outer wall of the lower portion of the connecting element is engaged with the inner wall of the sucking cylinder by expansion to fix the connecting element into the sucking cylinder.

Furthermore, wherein, the liquid smoke cup comprises a cup body having a hollow chamber, and a cup holder configured at a bottom of the cup body and hermetically connected with the cup body, the cup body and the sucking cylinder is integrally formed.

Furthermore, wherein, the atomizers each comprise a heating wire for atomizing the liquid smoke and a fiber element for supporting the heating wire and adsorbing the liquid smoke; the atomizing cup comprises a cup holder, a cup cylinder sleeved around the cup holder and a lid covering the cup cylinder and opposing to another end of the cup holder, and the cup holder, the cup cylinder and the lid cooperatively define an atomizing chamber; the atomizing chamber is further provided with a liquid storage element which is cylindrical and sleeved in the cup cylinder, the liquid storage element is provided with a cylindrical atomizer support therein for supporting and positioning the atomizers; the fiber element is fixed onto the atomizer support, and opposite ends thereof project out of a side wall of the atomizer support and abut against an inner wall of the liquid storage element, and the liquid smoke enters the atomizing chamber through the oil-guiding component and is adsorbed and stored in the liquid storage element and further infiltrated into the fiber element to be atomized.

Furthermore, wherein, the oil-guiding component is inverted Y-shaped, and comprises a head end and two tail ends, the head end of the oil-guiding component is inserted into the liquid smoke cup, and the two tail ends are extended into the atomizing chamber and respectively sandwiched between the inner wall of the liquid storage element and the outer wall of the atomizer support.

Furthermore, wherein, the atomizing device is sleeve around the connecting element by means of its cup cylinder so that the atomizing device is fixedly engaged with the connecting element to be secured into the sucking cylinder, a hermetical ring is configured between the inner wall of the sucking cylinder and the outer wall of the cup cylinder; the lower portion of the connecting element is provided with a flange radially outwardly extended from for positioning the sucking cylinder, inner threads for threadly engaging with the power rod, and intake holes.

A further object of the present invention is: to provide an electronic cigarette device, which has a function of sensing and measuring body temperature, or temperature of other objects or medium, such as the ambient temperature.

To achieve the above-mentioned object, the present invention disclose an electronic cigarette device, comprising an electronic cigarette as above described, and further comprising an electronic cigarette casing, for accommodating the electronic cigarette.

Furthermore, wherein, the electronic cigarette casing comprises a base box, a box cover covering the base box, and a thermometer module mounted to the base box or the box cover.

The technical advantages of the embodiments of the present invention are: firstly, since the electronic cigarette is provided with a thermometer module, the electronic cigarette has a function of sensing and measuring body temperature, or object temperature or medium temperature. Secondly, the atomizing device is detachably disposed in the sucking cylinder by means of the connecting element, it is easy to be disassembled and assembled, repaired or replaced, and can be reusable, and can be easily used.

Thirdly, two atomizers are adopted, which improves the atomizing speed of liquid smoke and the amount of smoke.

Finally, the sucking nozzle and the liquid smoke cup are integrally formed, which makes the electronic cigarette compact and can save costs.

The embodiments of the present invention are further described in detail in conjunction with the accompanying drawings.

DETAILED DESCRIPTION OF THE EMBODIMENTS

Figure 1:
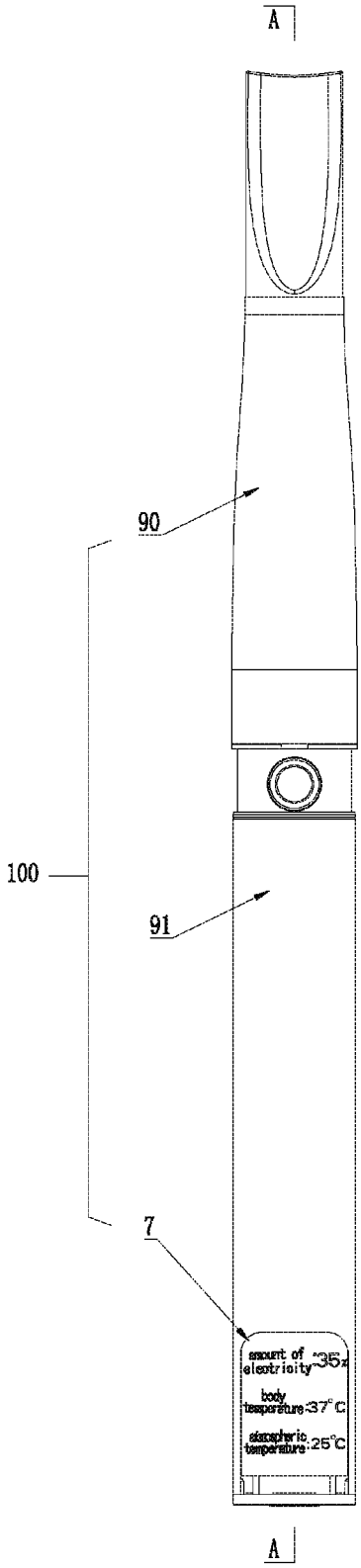
FIG. 1 is a front view of an electronic cigarette in accordance with an embodiment of the present invention.
Figure 2:
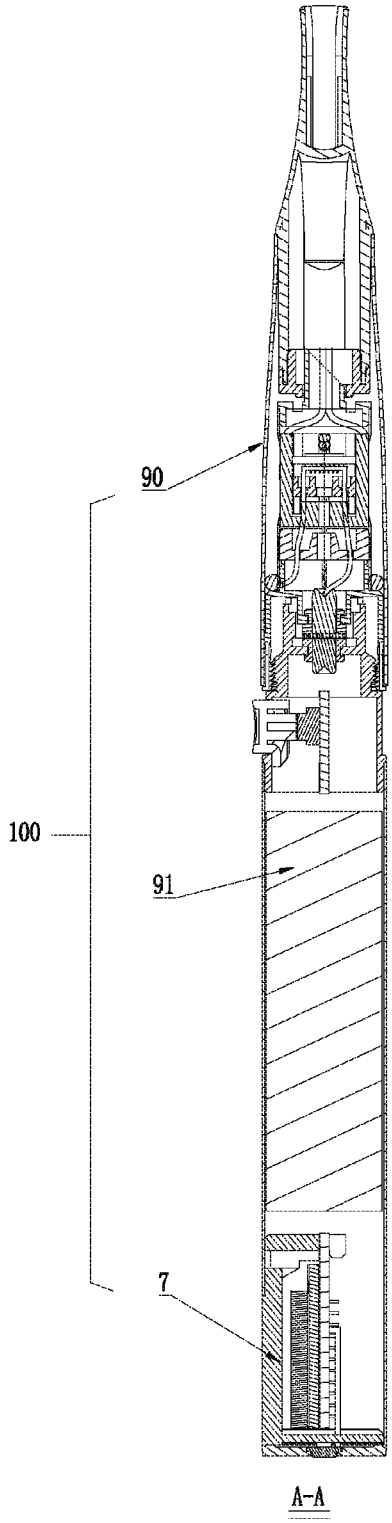
FIG. 2 is a cross-sectional view of FIG. 1, taken along A-A line.

As shown from FIG. 1 to FIG. 17, an electronic cigarette device having thermometer provided according to an embodiment of the present invention, comprise an electronic cigarette 100 and an electronic cigarette casing 200.

As shown from FIG. 1 to FIG. 11, the electronic cigarette 100 comprises an electronic cigarette sucking rod 90, a power rod 91 and a thermometer module 7, and the electronic cigarette sucking rod 90 and the power rod 91 are connected together by fastener, plug or thread, and in the embodiment they are connected by thread. Certainly, the sucking rod 90 and the power rod 91 can also be designed to have an integral structure. While the thermometer module 7 is disposed within an outer shell of the power rod 91, certainly the thermometer module 7 can also be disposed within an outer shell of the electronic cigarette sucking rod 90.

Figure 3:
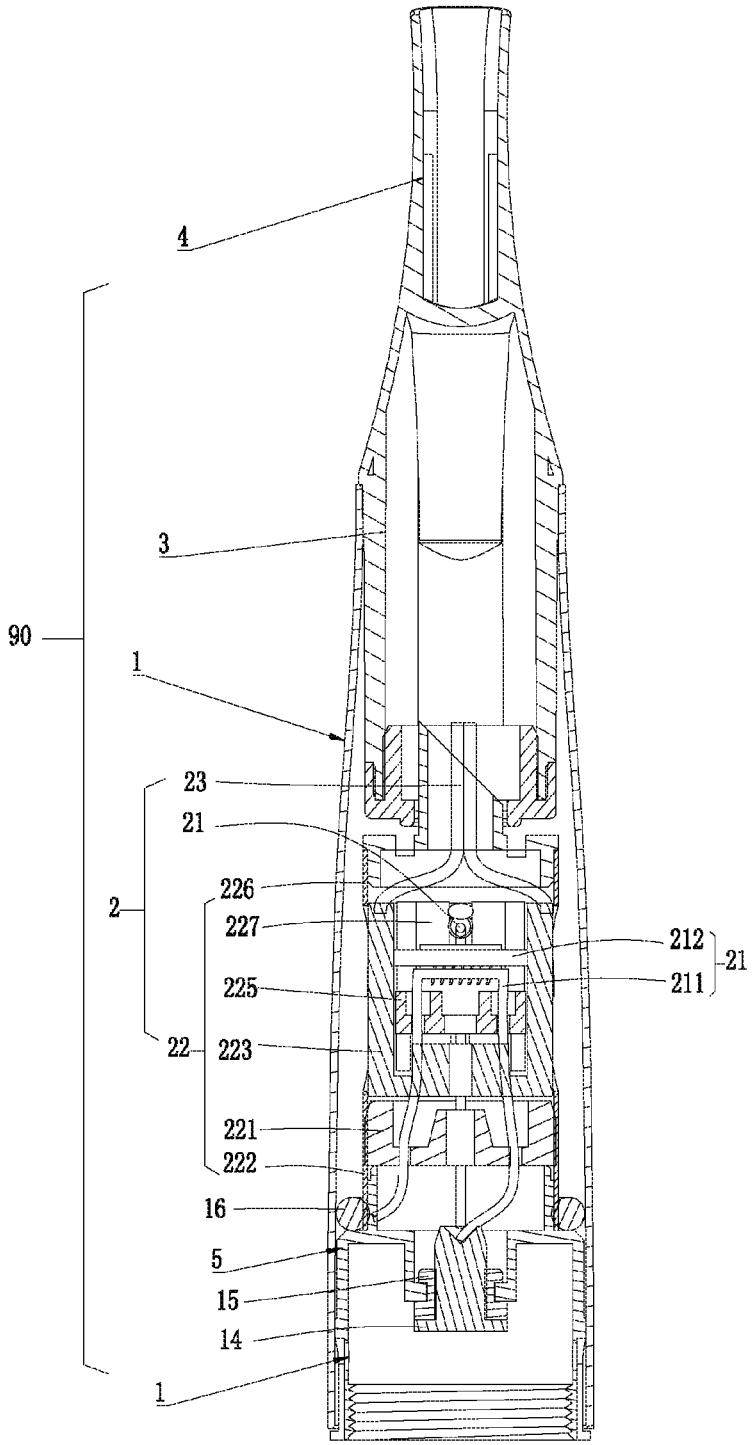
FIG. 3 is a cross-sectional view of a sucking rod of the electronic cigarette in accordance with the embodiment of the present invention.
Figure 4:
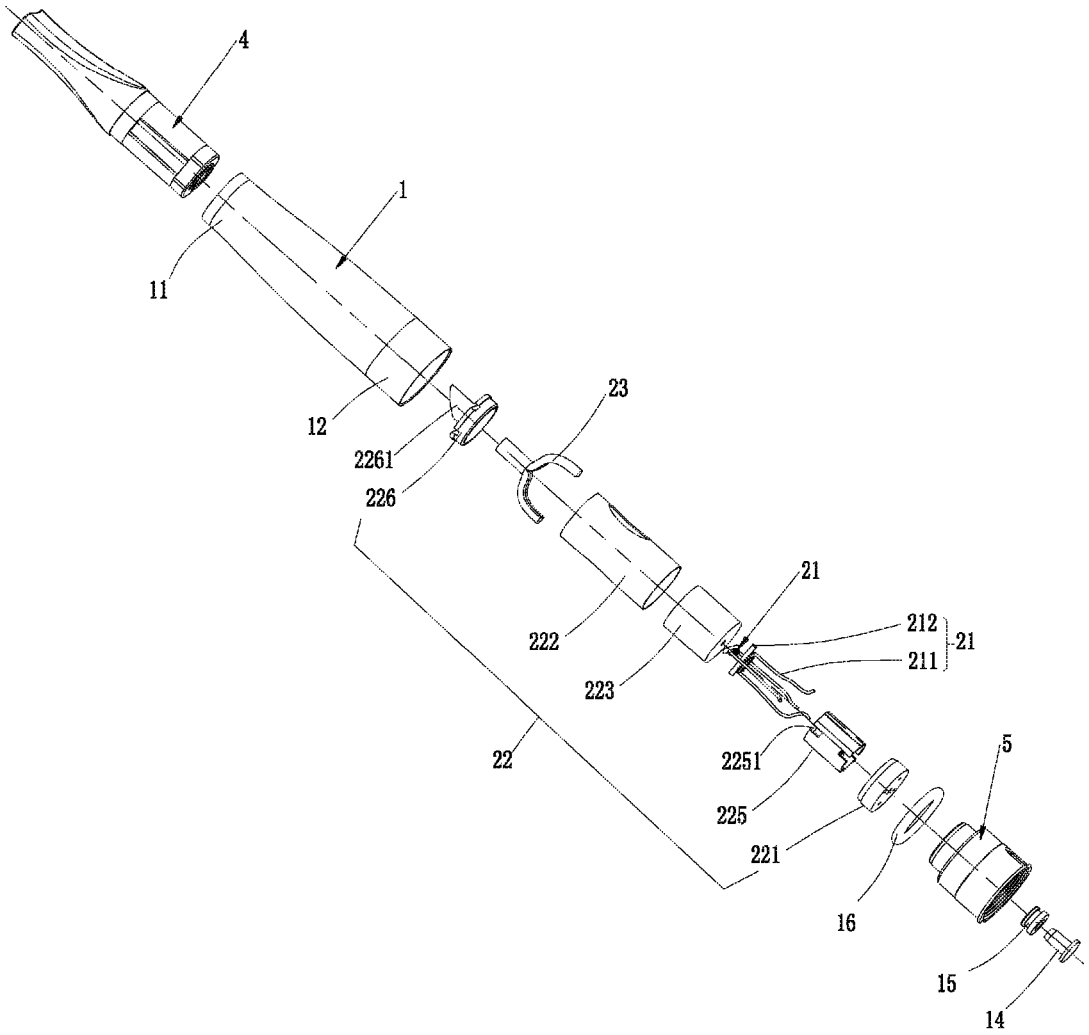
FIG. 4 is an exploded view of the sucking rod of the electronic cigarette in accordance with the embodiment of the present invention.
Figure 5:
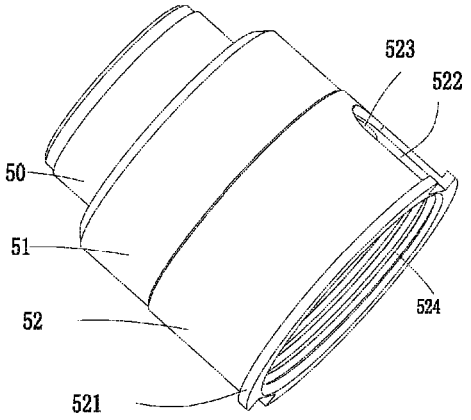
FIG. 5 is an isometric view of a connecting element of the sucking rod of the electronic cigarette in accordance with the embodiment of the present invention.
Figure 6:
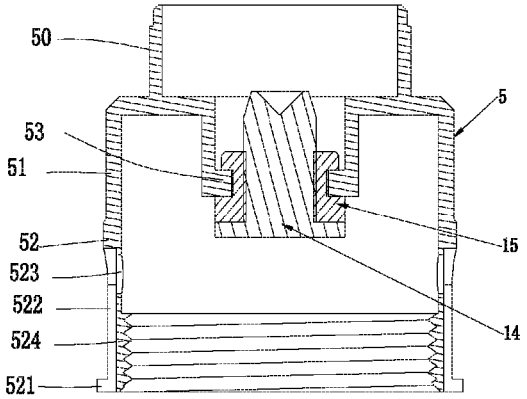
FIG. 6 is a cross-sectional view of the connecting element of the sucking rod of the electronic cigarette in accordance with the embodiment of the present invention.
Figure 7:
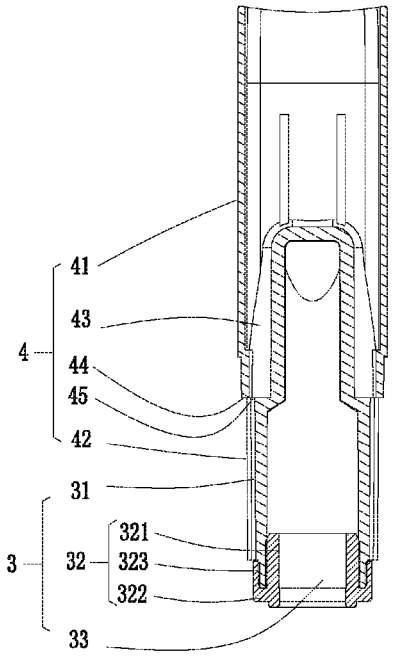
FIG. 7 is a cross-sectional view of a sucking nozzle and a liquid smoke cup of the sucking rod of the electronic cigarette in accordance with the embodiment of the present invention.
Figure 8:
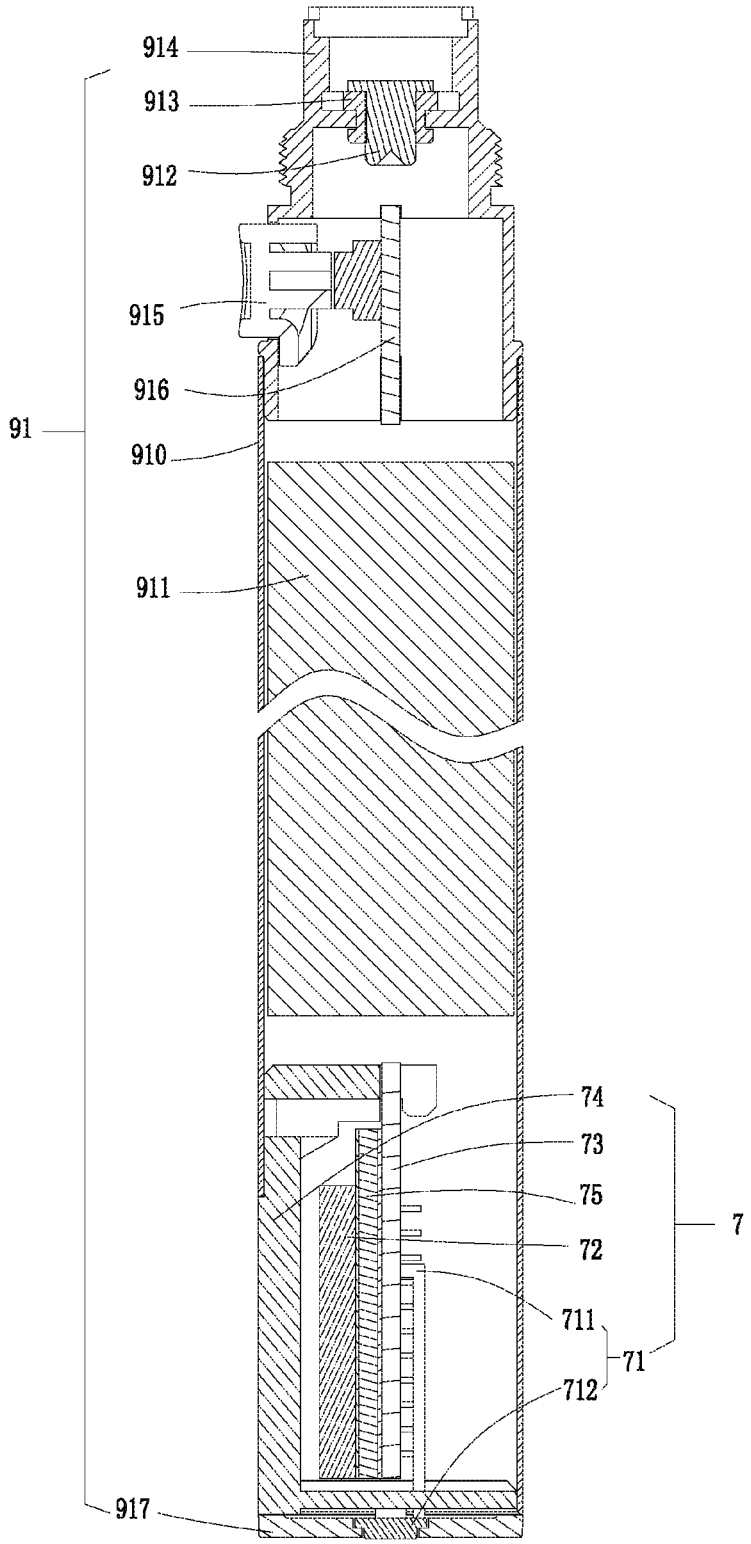
FIG. 8 is a cross-sectional view of a power rod of the electronic cigarette in accordance with the embodiment of the present invention.
Figure 9:
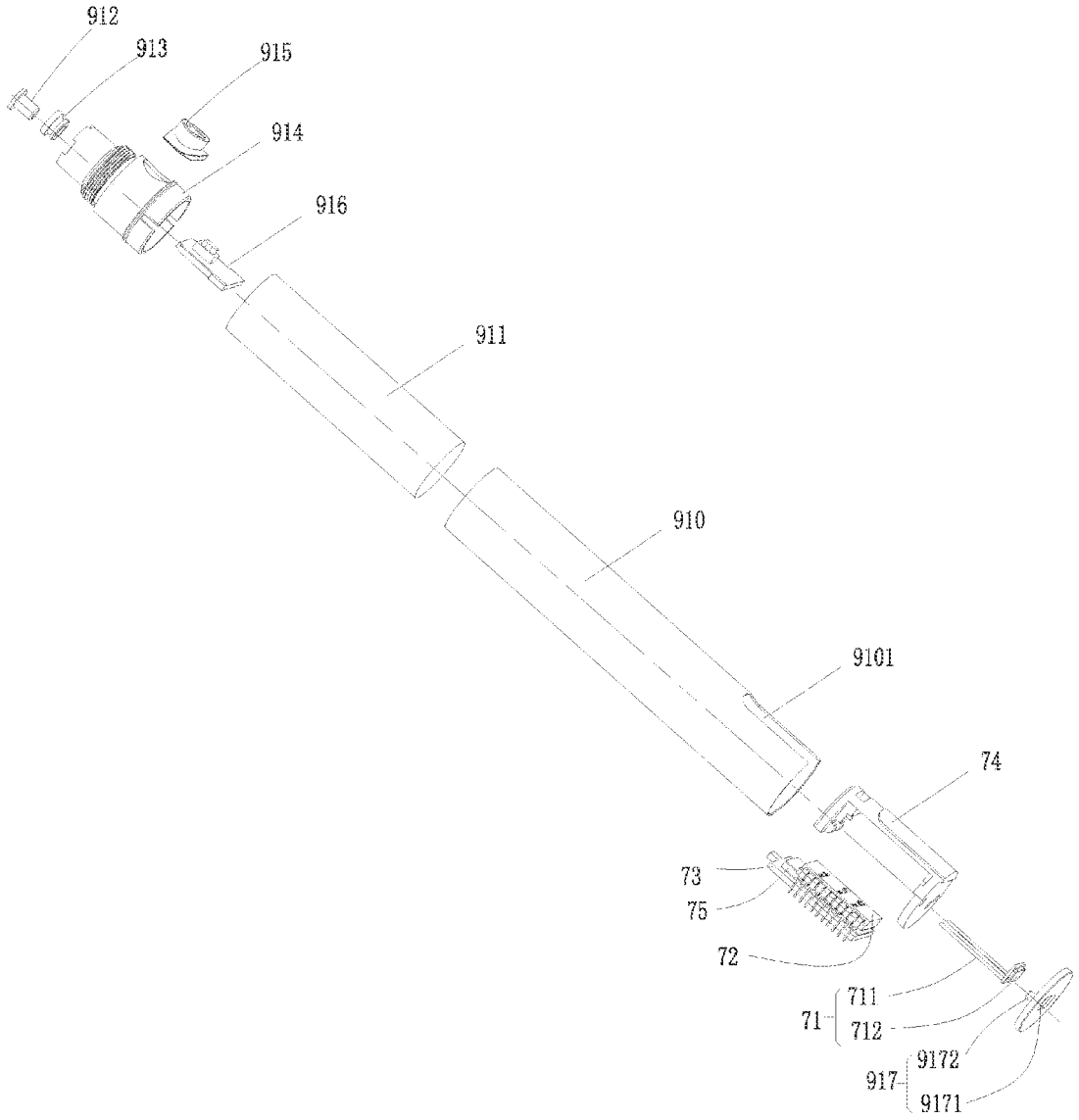
FIG. 9 is an exploded view of the power rod of the electronic cigarette in accordance with the embodiment of the present invention.
Figure 10:
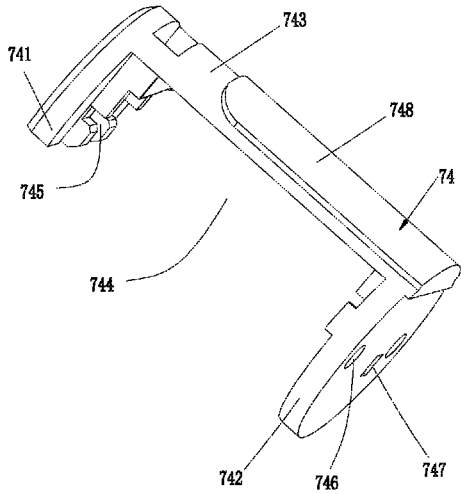
FIG. 10 is an isometric view of a support bracket of a thermometer module of the electronic cigarette in accordance with the embodiment of the present invention.

As shown in FIG. 3 and FIG. 4, the electronic cigarette sucking rod 90 comprises a sucking cylinder 1, an atomizing device 2 used for transferring the liquid smoke into foggy smoke, a liquid smoke cup 3 for storing liquid smoke, a sucking nozzle 4, and a connecting element 5 used for connecting with the power rod 91. The sucking nozzle 4 and the connecting element 5 are respectively disposed at two ends of the sucking cylinder 1, the atomizing device 2 is fixed into the sucking cylinder 1 by means of the connecting element 5, and the liquid smoke cup 3 is located within the sucking nozzle 4. Therefore, in the embodiment, the outer shell of the sucking rod 90 comprises the sucking nozzle 4 and the sucking cylinder 1.

The sucking cylinder 1 has an elongated hollow cylindrical structure. In the embodiment, it is substantially a cylindrical shell, and gradually becomes smaller along a direction toward the sucking nozzle 4, i.e., the sucking cylinder 1 is a sleeve having a predetermined taper. Certainly, other suitable shapes can also be feasible to the sucking cylinder. The sucking cylinder 1 is made of stainless steel, or can be made of plastic or other suitable materials. The sucking cylinder 1 can be designed to be whole transparent or at least partially transparent, or the portion thereof where the liquid smoke cup 3 is mounted is transparent to facilitate to observe the amount of the liquid smoke in the liquid smoke cup 3. The sucking cylinder 3 is opened at opposite ends thereof, and comprises a top portion 11 connected with the sucking nozzle 4 and a bottom portion 12 coupled with the power rod 91. The sucking cylinder 1 is further provided with a first electrode member 14 capable of being served as the positive electrode of the atomizing device 2, a first insulating collar 15 and a hermetical ring 16 for sealing the sucking cylinder 1. In the embodiment, the connecting element 5 is served as the second electrode of the atomizing device 2, for example, the negative electrode, and the first electrode member 14 is fixed into the connecting element 5 through the first insulating collar 15 and insulated from the insulating ring 15.

The connecting element 5 (see FIG. 5 and FIG. 6) is located at the bottom portion 12 of the sucking cylinder 1, for fixing the atomizing device 2 into the sucking cylinder 1. In the embodiment, the connecting element 5 itself also serves as the second electrode, which is made of metallic conductive materials, such as copper. The connecting element 5 has its shape fitted with the shape of the sucking cylinder 1. In the embodiment the connecting element 5 is a hollow cylinder having its opposite ends opened, and comprises an upper portion 50, a middle portion 51 and a lower portion 52 which are in turn increased in outer diameter. The upper portion 50 is for connecting with the atomizing device 2, and the middle portion 51 is for mounting the first electrode member 14 and the first insulating collar 15; a flange 521 is radially outwardly extended from a bottom extremity of the lower portion 52, for abutting against and positioning the sucking cylinder 1. The lower portion 52 defines intake indentions 522 which are indented inwardly from the sidewall of the lower portion and extended along an axial direction from the bottom extremity of the lower portion, the intake indentions 522 define intake holes 523 which are radially extended through the lower portion 52, for external air to enter the sucking cylinder 1 through the connecting element 5. Inner wall of the bottom end of lower portion 52 forms inner threads thereon for threadly engaging with the power rod 91. The lower portion 52 of the connecting element 5 is fixed to an inner wall of the sucking cylinder 1 by expansion, and at the same time fixes the atomizing device 2 into the sucking cylinder 1. The hermetical ring 16 is configured between the outer wall of the atomizing device 2 and the inner wall of the sucking cylinder 1, for preventing leakage of the liquid smoke from the sucking cylinder 1. The electronic cigarette sucking rod 90 is electrically connected with a second electrode in the power rod 91 through the connecting element 5, and is electrically connected with a first electrode in the power rod 91 through the first electrode member 14 fixed into the connecting element 5.

The atomizing device 2 (see FIG. 3 and FIG. 4) comprises atomizers 21, an atomizing cup 22 and an oil-guiding component 23. The atomizers 21 are for transferring the liquid smoke into fogged smoke, and each comprise a heating wire 211 and a fiber element 212. The heating wire 211 is wound around the fiber element 212, and is accommodated and fixed into the atomizing cup 22 through the fiber element 212. In the embodiment, two atomizers 21 are adopted for atomizing, to increase the amount of the fogged smoke. The fiber elements 212 are configured crosswise within the atomizing cup 22. The fiber elements 212 are made of fiberglass or other heat-resistant fibers.

The atomizing cup 22 comprises a cup holder 221, a cup cylinder 222, a liquid storage element 223, atomizer support 225, and a lid 226, and the atomizing cup 22 defines an atomizing chamber 227 therein.

The cup holder 221 is made of plastic materials, and is fitted with the cup cylinder 222 in shape and size. In the embodiment, it is cylindrical, and defines a venthole axially extended therethrough and multiple perforations for the heating wire 211 to pass through. Outer wall of the cup holder 221 is fixed to a bottom end of the cup cylinder 222 by expansion and spaced from the bottom end of the cup cylinder 222 with a proper distance.

The cup cylinder 222 has a hollow cylindrical structure, and is capable of being made of plastic materials. The cup cylinder 222 defines a through hole axially extended from a central portion thereof.

The liquid storage element 223 is for absorbing and reserving the liquid smoke entered the atomizing cup 22 from the oil-guiding component 23 to facilitate a subsequent atomization of the liquid smoke by the atomizer 21, it is capable of absorbing and reserving liquid like a sponge, and being made of a material of fiberglass or absorbent cotton capable of absorbing liquid and reserving liquid. The liquid storage element 223 is sleeved within the cup cylinder 222 and mutually engaged with the inner wall of the cup cylinder 222 by expansion, and has a hollow cylindrical structure. The liquid storage element 223 is internally provided with a receiving chamber for accommodating the atomizer support 225, positioning posts axially extended from a bottom toward a top of the liquid storage element 223 in a proper height, a venthole axially extended through the liquid storage element and multiple perforations for the heating wire 211 to pass through.

The atomizer support 225 also has a hollow cylindrical structure, and the atomizer support 225 is received in the receiving chamber of the liquid storage element 223. The atomizer support 225 has its inner wall to be sleeved around the positioning posts of the liquid storage element 223, and an outer wall of the atomizer support 22 is engaged with an inner wall of the liquid storage element 223 by expansion, for serving as a supporting frame. The atomizer support 225 is capable of being made of ceramic material, and the atomizer support 225 defines a pair of locking slots 2251 radially extended through an upper portion of sidewall of the atomizer support 225, for positioning the fiber elements 212 of the two atomizers 21, to ensure that opposite ends of the fiber elements 212 can sufficiently contact with the inner wall of the liquid storage element 223 to thereby adsorb the liquid smoke in the liquid storage element to be atomized. Since two atomizers 21 are adopted in the embodiment, the locking slots 2251 in the atomizer support 225 are crosswise, for respectively positioning corresponding fiber elements 212 of the two atomizers 21. The atomizer support 225 internally defines a venthole and multiple perforations for the heating wire 211 to pass through.

The lid 226 is for positioning the oil-guiding component 23, and seems like a steeple crown-shaped cap, and covers an end of the cup cylinder 222 which opposes to the cup holder 221. Preferably, the lid 226 is a metallic element.

In the embodiment, the atomizing chamber 227 is a hollow chamber which is cooperatively defined by the cup holder 221, the cup cylinder 22 and the lid, while the fiber elements 212 of the atomizers 21 are axially positioned by means of the liquid storage elements 223, and are radially positioned by means of the locking slots 2251 of the atomizer support 225 to be thereby fixed into the atomizing chamber 227. The liquid storage element 223 and the atomizer support 225 are fixed into the atomizing chamber 227.

The oil-guiding component 23 is for guiding the liquid smoke within the liquid smoke cup 3 into the atomizing cup 22, and the oil-guiding component 23 is made of fiber material. In the embodiment, the oil-guiding component 23 is inverted Y-shaped, passed through and fixed into an annular tube 2261 of the lid 226. The oil-guiding component 23 comprises a head end and two tail ends, the head end is extended into the liquid smoke cup 3, and the tail ends both are extended into the atomizing cup 22 and sandwiched between the inner wall of the liquid storage element 223 and the outer wall of the atomizer support 225, so that the liquid smoke can be adsorbed from the liquid smoke cup 3 and transferred into the liquid storage element 223. Opposite ends of the fiber elements 212 adsorb the liquid smoke in the liquid storage element 223 for atomization. The oil-guiding component 23 makes the electronic cigarette sucking rod 90 to be easily assembled, and has good oil-guiding effect.

During installation, the two fiber elements 212 are crosswise arranged within the atomizing cup 22, the fiber elements 212 are fixed into the atomizing chamber 227 by means of the locking slots of the atomizer support 225, which is easy to be installed; the heating wire 211 is wound around the fiber elements 212, one end of the heating wire 211 respectively passes through corresponding perforations in the atomizer support 225, the liquid storage element 223 and the cup holder 221 and welded to the inner wall of the upper portion 50 of the connecting element 5 to realize an electrical connection with the negative electrode of the power rod 91; another end of the heating wire 211 respectively passes through corresponding perforations in the atomizer support 225, the liquid storage element 223 and the cup holder 221 and welded to the first electrode member 14 which is fixed to the connecting element 5 to achieve the electrical connection with the positive electrode of the power rod 91.

The liquid smoke cup 3 (see FIG. 7) is for storing the liquid smoke, and comprises a cup body 31 and a cup holder 32 hermetically connected with the cup body 31. The cup body 31 is a hollow cylinder, with its top end sealed and its bottom opened for injecting the liquid smoke. The cup body 31 may be made of transparent or translucent plastic materials. The cup holder 32 is for covering the bottom open of the cup body 31, the cup holder 32 comprises a cylindrical seat body 321, the seat body 321 outwardly forms a positioning step 322 from its bottom portion for engaging with the cup body 31, an inserting slot 323 is defined between the positioning step 322 and the seat body 321 for fitting with a bottom portion of the cup body 31, and the cup holder 32 and the bottom of the cup body 31 are engaged by expansion to seal the cup body 31; the cup holder 32 defines a liquid passage 33 axially extended therethrough for injecting the liquid smoke, and the liquid passage 33 is fitted with the annular tube 2261 of the lid 226 in shape and size.

The sucking nozzle 4 (see FIG. 7) comprises an inhaling end 41 and an inserting end 42 fitted with the top portion 11 of the sucking cylinder 1. The inhaling end 41 has a hollow inner chamber, which axially forms a sucking hole 43. A positioning step 44 for engaging with the sucking cylinder 1 and a venthole 45 for communicating an interior of the sucking cylinder 1 with the sucking hole 43, are configured between the inhaling end 41 and the inserting end 42. The inserting end 42 is inserted into the top portion 11 of the sucking cylinder 1, and fixed to the inner wall of the sucking cylinder 1 by expansion. In the embodiment the sucking nozzle 4 and cup body 31 of the liquid smoke cup 3 are integrally formed.

The power rod 91 comprises a sheath 910, a power supply 911 disposed within the sheath 910, a second electrode member 912 serving as a positive electrode, a second insulating ring 913, a connecting sleeve 914 for engaging with the connecting element 5, a power switch 915, an atomizer control circuit board 916 and a bottom cap 917. The connecting sleeve 914 and the bottom cap 917 are respectively configured at opposite ends of the sheath 910. The sheath 910 further defines a locking slot 9101 (see FIG. 9) at its bottom for installing the thermometer module 7. The bottom cap 917 defines a through hole 9171 and an inserting post 9172. The switch 915 is for controlling the atomizers 21 and the thermometer module 7 to work. If the switch 915 is pressed for a relatively long time, the thermometer module 7 starts to work, for measuring temperature; if the switch 915 is pressed for a relatively short time, the atomizers 21 start to work, for smoking; it depends on the actual requirement how to use the switch 915 to control the electronic cigarette 100. The atomizer control circuit board 916 is electrically connected with the power supply 911, and the connecting sleeve 914 is electrically connected with the power supply 911 via the atomizer control circuit board 916. The connecting sleeve 914 is threadly connected with the connecting element 5 so that negative electrodes of the atomizers 21 are electrically connected with the negative electrode of the power supply 911. The second electrode member 912 is fixed into the connecting sleeve 914 via the second insulating ring 913, and the second electrode member 912 is electrically connected with another electrode in the power rod 91 via the atomizer control circuit board 916. The second electrode member 912 is for abutting against the first electrode member 14 in the connecting element 5 to conduct the circuit. The power switch 915 is configured on the outer wall of the power rod 91, to control the electronic cigarette to be energized or de-energized through the power switch 915. The circuit is connected when the power switch 915 is pressed, and direction of the current is: from the positive electrode of the power supply 911 to the second electrode member 912, and then from the electrode member 51 inside the connecting element 5 to the positive electrode of the heating wire 211, through the negative electrode of the heating wire 211 to the connecting member 51, and finally from the outer wall of the connecting element 5 to the negative electrode of the power rod 91 through the connecting sleeve 914. In the embodiment, the outer shell of the power rod 91 comprises the sheath 910 and the bottom cap 917. Certainly, when the power rod 91 and the sucking rod 90 are integrally configured, the outer shell of the power rod 91 is correspondingly the sucking cylinder 1 of the sucking rod 90.

The thermometer module 7 is configured in the power rod 91, for sensing and measuring the body or object temperature or ambient temperature of the electronic cigarette. In the embodiment, the thermometer module 7 is disposed at a bottom of the sheath 910, and fixed into the sheath 910 by means of mutual engagement of the bottom cap 917 and the locking slot 9101 of the sheath 910. The thermometer module 7 comprises a measuring unit 71 for sensing the body or object temperature or ambient temperature, a display unit 72 and a circuit processing unit connecting the measuring unit and the display unit. The circuit processing unit is for receiving and processing the data generated by the measuring unit 71, and controlling the display unit 72 to display the data. In the embodiment, the circuit processing unit is integrated onto a thermometer circuit board 73, and powered by the power supply 911 in the power rod 91.

Figure 11:
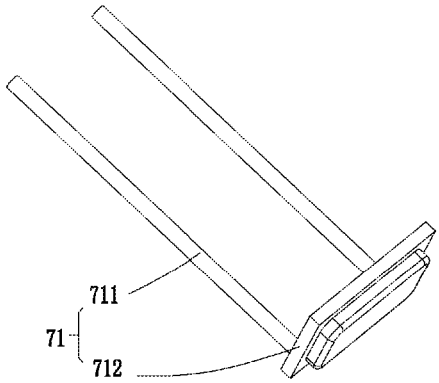
FIG. 11 is an isometric view of a measuring unit of the thermometer module of the electronic cigarette in accordance with the embodiment of the present invention.

In the embodiment, the measuring unit 71 is a temperature sensor, and comprises a temperature sensing component 712 and pins 711 as electrodes (see FIG. 11). The temperature sensing component 712 is in contact with object or body to get the temperature data; the pins 711 are for electrically connecting the temperature sensing component 712 to circuit processing unit. In the embodiment, since the circuit processing unit is integrated onto the thermometer circuit board 73, the temperature sensing component 712 is thus electrically connected to the temperature circuit board 73 via the pins 711, and the pins 711 after bent is welded to the thermometer circuit board 73, to transfer the temperature data of the temperature sensing component 712 to the circuit processing unit on the thermometer circuit board 73, and then the circuit processing unit controls the display unit 72 to display the temperature data.

In the embodiment a support bracket 74 is further provided. The support bracket 74 is fitted with an inner wall the sheath 910 in shape, and is made of transparent plastic material. In the embodiment, the support bracket 7 comprises a substantially round upper plate 741, a substantially round lower plate 742 and an arc-shaped side plate 743 to connect the upper plate 741 and the lower plate 742. The plates surround a receiving chamber 744, and the display unit 72 and the thermometer circuit board 73 are received into the receiving chamber 744. The support bracket 74 further comprises a locking slot 745 defined in the upper plate 741 for fixing the thermometer circuit board 73, pin holes 746 defined in the lower plate 742 for being fitted with the pins 711 and an inserting hole 747 defined in the lower plate 742 for insertably engaged with the inserting post 9172. The side plate 743 defines a display window 748 corresponding to the display unit 72 and fitted with the locking slot 9101 of the sheath 910. The display window 748 is an arc-shaped convex surface which projects outward from the outer wall of the side plates 743 in appropriate thickness, and is transparent or translucent. The data displayed by the display unit 72 can be observed through the display window 748. The display window 748 can also be an opening.

The display unit 72 comprises a display screen, for displaying the measured temperature, at the same time for also displaying other data, such as the electricity, room temperature, etc. In the embodiment, the display unit 72 is mounted onto the thermometer circuit board 73, and located at a bottom of the display window 748. During installation, an insulating heat shield 75 is configured between the display unit 72 and the thermometer circuit board 73. The pins 711 of the measuring unit 71 are fitted with the pin holes 746, while the temperature sensing component 712 is fitted with the through hole 9171 of the bottom cap 917, and the pins 711 pass through the pin holes 746, and are welded to the thermometer circuit board 73 after being bent, while a sensing end of the temperature sensing component 712 projects out of the bottom cap 917 via the through hole 9171.

The temperature sensing component 712 of the embodiment adopts thermistor, according to the principle of measuring temperature of the thermistor, when the temperature sensing component 712 is in contact with the human body or other objects, the temperature sensing component 712 achieves the contact temperature or external temperature, and converts it into current signal, when the resistance value of the temperature sensing component 712 get changed, the variation is transmitted to the circuit processing unit of the thermometer circuit board 73 to be processed. The circuit processing unit receives and converts the current variation, and controls the display unit 72 to display the measured temperature value. This kind of electronic cigarette is proposed with a new function, and is capable of accurately measuring the temperature of human body or other objects, which is simple to operate, and easy to use.

The measuring unit 71 of the embodiment is configured within the outer shell of the power rod 91. Certainly, the measuring unit 71 can also be configured on the sucking nozzle 4, when the sucking nozzle 4 is put in the mouth or in contact with the human body, the measuring unit 71 can also measure the body temperature. Understandably, the circuit processing unit can also be integrated onto the atomizer control circuit board 916 of the electronic cigarette. The thermometer module 7 can be disposed at any appropriate place of the outer shell of the electronic cigarette, including but not limited by the sucking nozzle 4, the sucking cylinder 1, the sheath 910 or bottom cap 917, so long as the shape of the thermometer module 7 is fitted to the corresponding place of the outer shell of the electronic cigarette. Similarly, the display unit 72 can also be disposed at any appropriate place of the outer shell of the electronic cigarette, so long as the display window is also disposed at the corresponding place of the outer shell of the electronic cigarette, to thereby display the temperature data.

As shown from FIG. 12 to FIG. 17, the cigarette casing 200 comprises a base box 81 for accommodating the electronic cigarette 100, and a box cover 82. The base box 81 is provided with a thermometer module 7' therein for sensing and measuring body temperature or ambient temperature of the electronic cigarette, and a charging module 87 including a rechargeable battery 871. The rechargeable battery 871 is for charging the electronic cigarette 100 and providing power supply to the thermometer module 7'.

Figure 12:
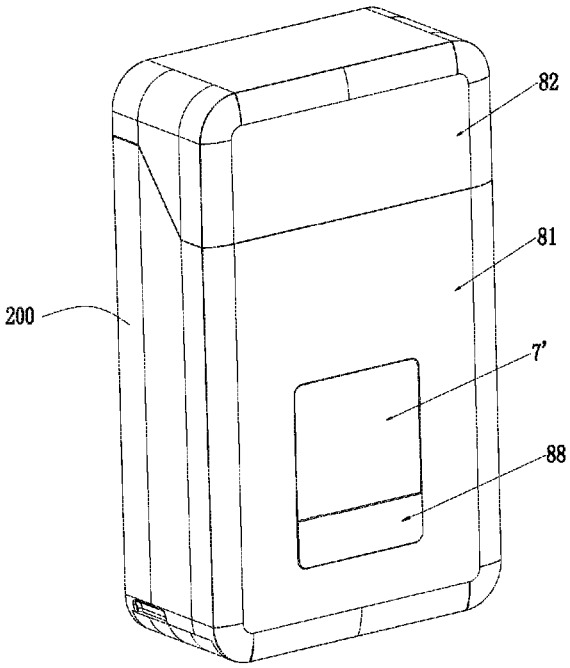
FIG. 12 is an isometric view of an electronic cigarette casing in accordance with the embodiment of the present invention.
Figure 13:
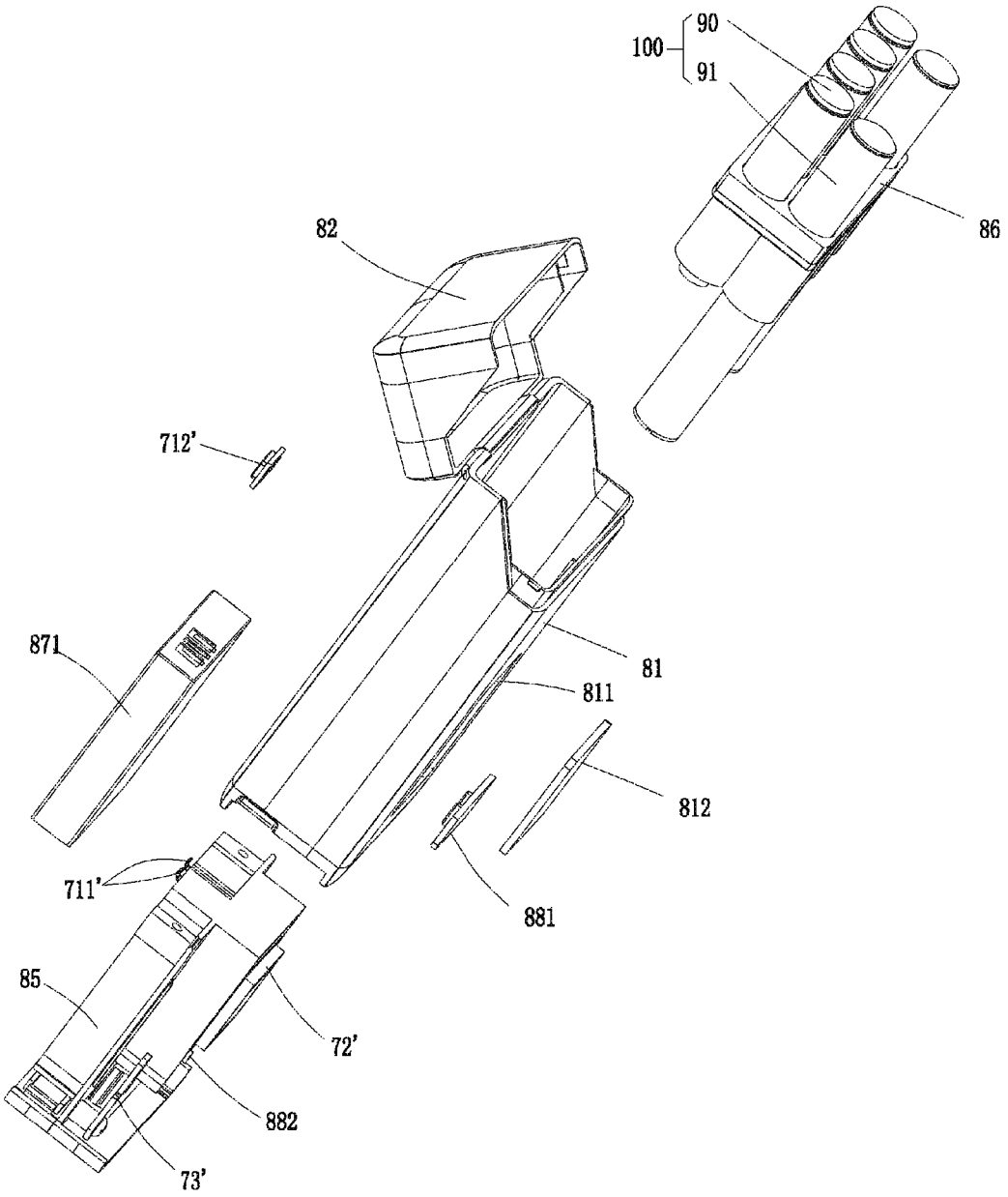
FIG. 13 is an exploded view of the electronic cigarette casing in accordance with the embodiment of the present invention.
Figure 14:
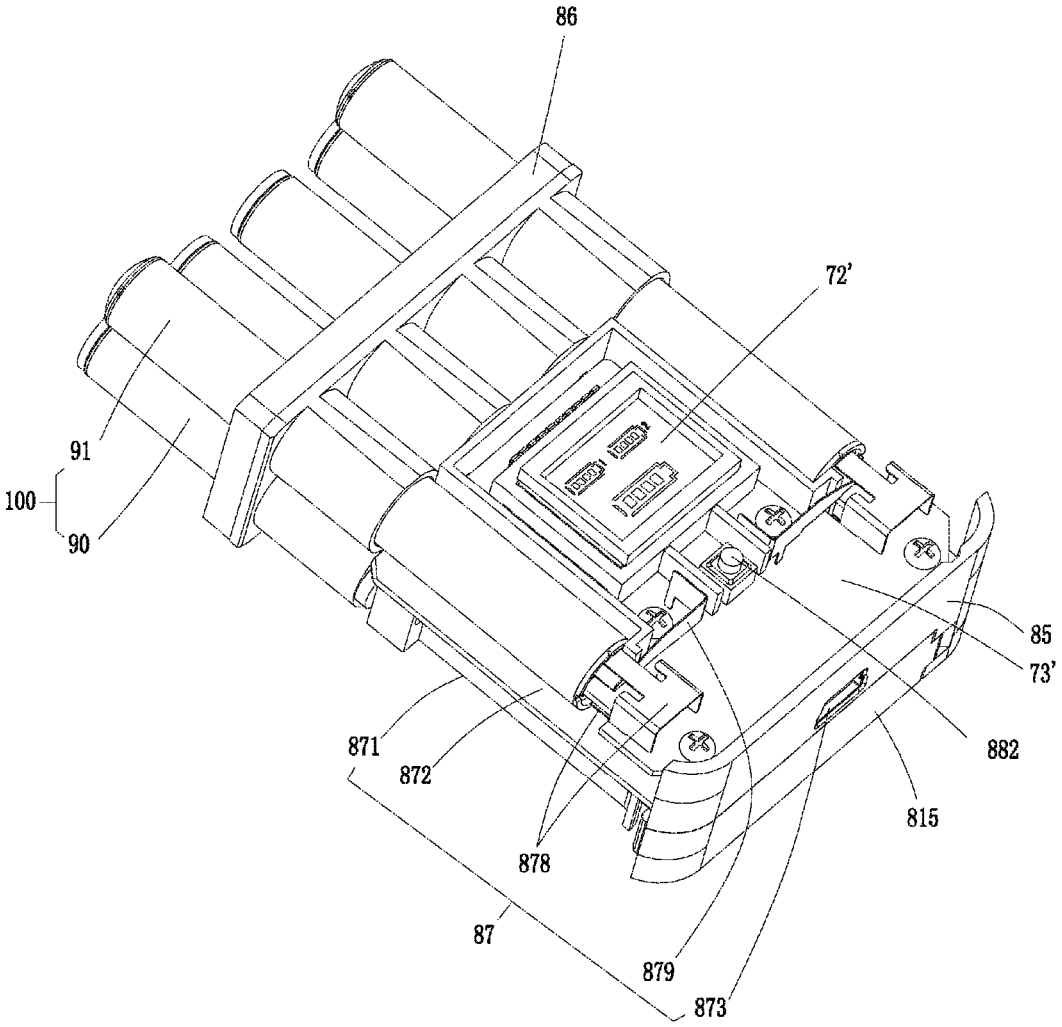
FIG. 14 is an isometric view of the electronic cigarette casing after removing its outer shell in accordance with the embodiment of the present invention.

As shown from FIG. 12 to FIG. 14, the base box 81 is a rectangular box, certainly, the base box 81 is not limited to have rectangular shape, other shapes, such as circular, oval, polygonal shapes are feasible, so long as the box cover 82 is fitted with the base box. The base box 81 is provided with a first support frame 85 therein for accommodating the rechargeable battery 871, a second support frame 86 for clamping and supporting the electronic cigarette 100, said charging module 87 and a key module 88. The base box 81 defines an observing hole 811, a display window 812 covering the observing hole 811, a button hole 813 (see FIG. 15), a sensor mounting hole 814 (see FIG. 15), and a battery cover 815 located at a bottom of the base box 81.

The box cover 82 is pivotally mounted onto the base box 81.

The first support frame 85 is fixed into the base box 81, the first support frame 85 defines a receiving slot 851, and the thermometer module 7 is accommodated and fixed into the receiving slot 851, the first support frame 85 is made of metallic or plastic material. The first support frame 85 further defines a penetrating slot 852.

The second support frame 86 is fixed into the base box 81, and disposed above the first support frame 85, for clamping supporting the electronic cigarette 100. The second support frame 86 is made of elastic plastic material.

Figure 15:
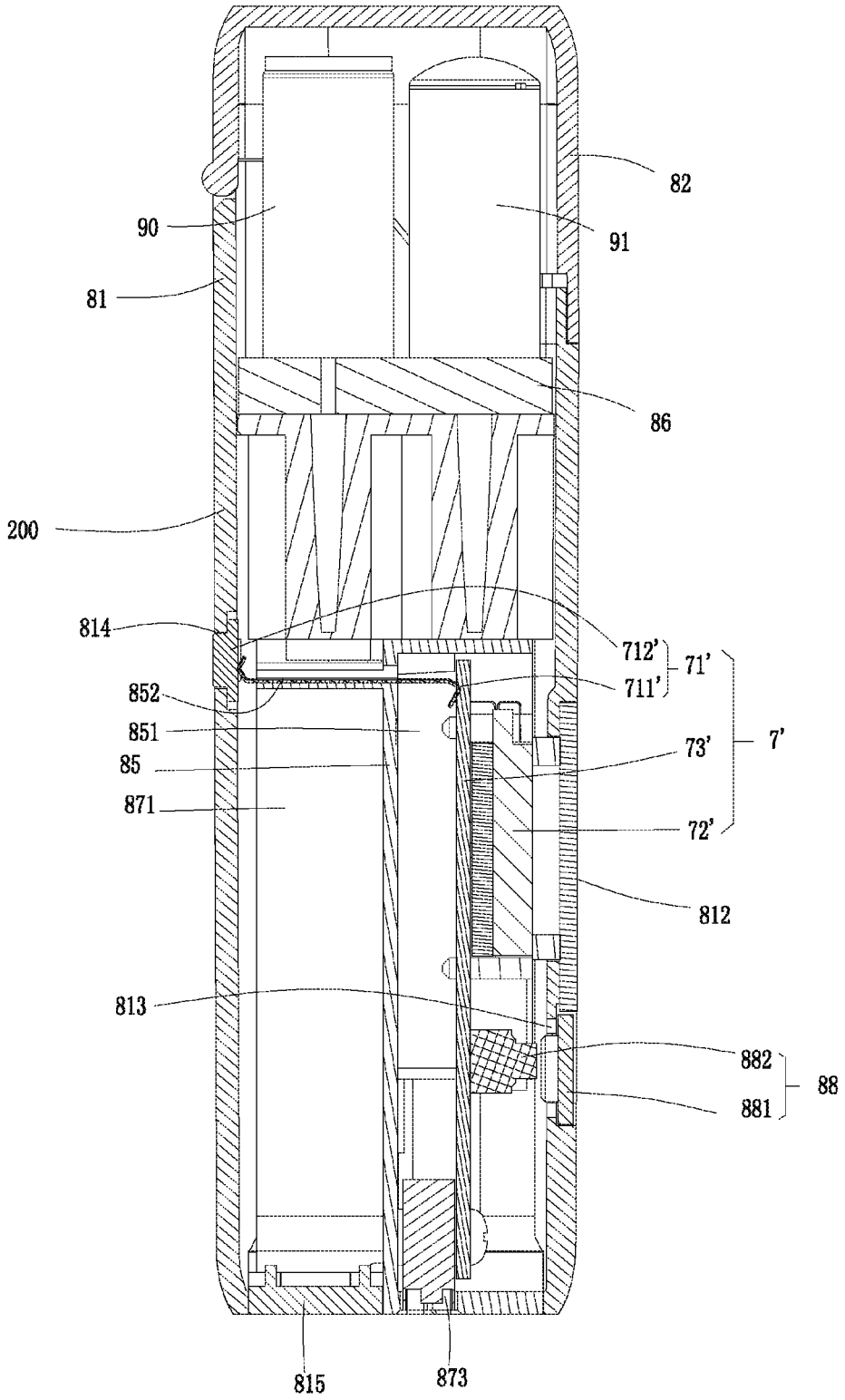
FIG. 15 is a cross-sectional view of the electronic cigarette casing in accordance with the embodiment of the present invention.
Figure 16:
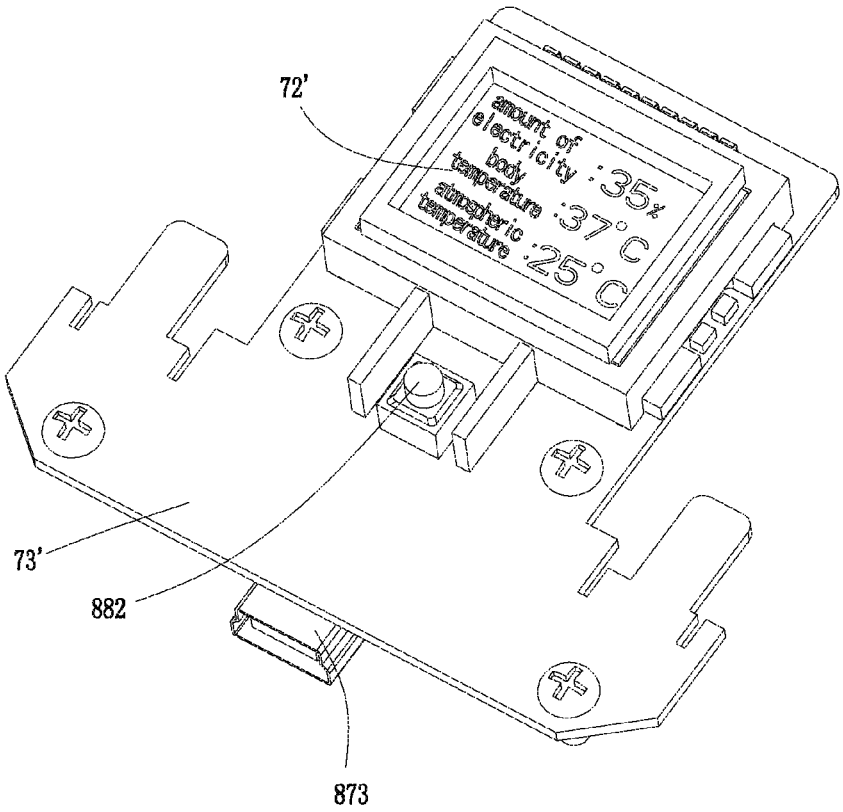
FIG. 16 is a schematic view of a thermometer circuit board of the electronic cigarette casing in accordance with the embodiment of the present invention.

As shown in FIG. 14, the charging module 87 is disposed in the base box 81, and comprises the rechargeable battery 871, a charging socket 872, an USB port 873 for insertably engaging with external power supply, and a charging circuit processing unit electrically connected with the rechargeable battery 871, the charging socket 872 and the USB port 873. In the embodiment, the rechargeable battery 871 is inserted into the base box 81 through the bottom wall of the base box 81, and is sealed and fixed into the base box by the battery cover 815. The rechargeable battery 871 is for charging the electronic cigarette 100, and the charging socket 872 is positioned by the first support frame 85 in cooperation with the second support frame 86. The charging socket 872 is provided with a first electrode flake 878 and a second electrode flake 879 respectively fitted with the positive and negative electrodes of the power rod 91 of the electronic cigarette 100. The first electrode flake 878 and the second electrode flake 879 are electrically connected with the positive electrode and the negative electrode of the rechargeable battery 871, respectively. In the embodiment, an inner wall of the threaded end of the power rod 91 is served as the first electrode to elastically abut against the first electrode flake 878 to be conducted, the second electrode flake 879 elastically abuts against another electrode in the threaded end of the power rod 91 to be conducted (as shown in FIG. 15). When the power rod 91 is inserted into the charging socket 872, the rechargeable battery 871 automatically charges the power rod 91, and the power rod 91 is automatically disconnected when the power rod 91 is fully charged. The USB port 873 is for connecting with external power supply to charge the rechargeable battery 871. The USB port 873 and the charging circuit processing unit are integrated onto the thermometer circuit board 73' of the thermometer module 7' described hereafter.

As shown in FIG. 15, the key module 88 comprises a key 881 configured at a side wall of the base box 81 and a control button 882 configured on the thermometer module 7' and fitted with the key 881. In the embodiment, the control button 882 is integrated on the thermometer circuit board 73' of the thermometer module 7' described hereafter. In use, the key 881 is pressed in a predetermined long time, the electronic cigarette casing 200 enters a charging mode, the rechargeable battery 871 automatically charges the electronic cigarette 100; the key 881 is pressed rapidly, the electronic cigarette casing 200 enters a temperature measuring mode, the thermometer module 7' starts to measure the temperature. Certainly, the usage of the key 881 can be predetermined to work in other manners according to the actual requirement.

The thermometer module 7' has the same function and principle as the thermometer module 7. As shown from FIG. 15 to FIG. 17, the thermometer module 7' is configured in the base box 81, for sensing and measuring the body temperature and ambient temperature of the electronic cigarette. In the embodiment, it is fixed into the receiving slot 851 of the first support frame 85. The thermometer module 7' comprises a measuring unit 71' for sensing the body or object temperature or ambient temperature, a display unit 72' and a circuit processing unit connecting the measuring unit and the display unit. The circuit processing unit is for receiving and processing the data generated by the measuring unit 71', and controlling the display unit 72' to display the data. In the embodiment, the circuit processing unit is integrated onto a thermometer circuit board 73', and powered by the rechargeable battery 871 in the base box 81. The thermometer circuit board 73' is fixed to the first support frame 85, and the display unit 72' is fixed to the thermometer circuit board 73' and its display screen faces the observing hole 811, while the measuring unit 71' is fixed to the base box 81.

Figure 17:
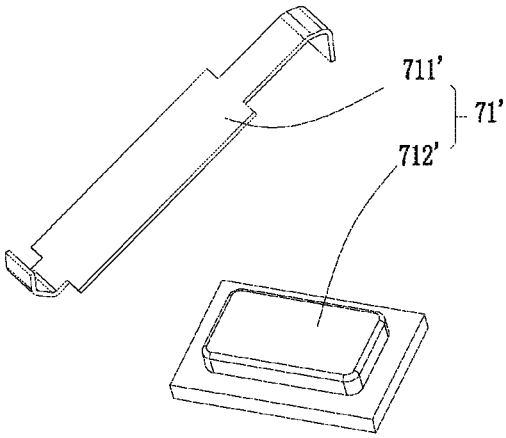
FIG. 17 is an exploded view of a temperature sensing component of the thermometer module of the electronic cigarette casing in accordance with the embodiment of the present invention.

As shown in FIG. 17, the measuring unit 71' comprises a temperature sensing component 712' and an electrode flake 711' as the electrode. The temperature sensing component 712' is in contact with object or body to get the temperature data; and the electrode flake 711' is for electrically connecting the temperature sensing component 712' to circuit processing unit, and it is formed by bending a thin sheet of metal. In the embodiment, it is S-shaped, and is elastic. Since the circuit processing unit is integrated onto the thermometer circuit board 73', the temperature sensing component 712' is thus electrically connected to the temperature circuit board 73' via the electrode flake 711', and the electrode flake 711' is arranged in the penetrating slot 852 of the first support frame 85. The electrode flake 711' has its one end to abut against the temperature sensing component 712's to be conducted, and has its another end to abut against the thermometer circuit board 73' to be conducted (as shown in FIG. 15), to transmit the temperature data sensed by the temperature sensing component 712' to the circuit processing unit on the thermometer circuit board 73', and the circuit processing unit controls the display unit 72' to display the temperature data. The temperature sensing component 712' of the measuring unit 71' is fitted with the sensor mounting hole 814 of the base box 81, and the sensing end of the temperature sensing component 712' projects out of the base box 81 via the sensor mounting hole 814.

When the power rod 91 is inserted into the charging socket 872 of the first support frame 85, the rechargeable battery 871 automatically charges the power rod 91, and the power rod 91 is automatically disconnected under the control of the thermometer circuit board 73' when the power rod 91 is fully charged.

Since the thermometer module 7' and the thermometer module 7 have the same function and principle, the detail description of the function and principle of the thermometer module 7' is no longer described in detail here.

The above-mentioned is only the embodiments of the present invention. It should be noted, for the persons of ordinary skill in this field, improvements and modifications within the spirit of the present invention can be made, and the improvements and modifications should be seemed to be included in the claimed scope of this invention.

What is claimed is:

1. An electronic cigarette, comprising: an outer shell, and further comprising a thermometer module disposed on the outer shell; wherein, the thermometer module comprises a measuring unit, a display unit and a circuit processing unit; and the measuring unit gets a temperature data of an object to be measured or medium and transmits the temperature data to the circuit processing unit, and finally the circuit processing unit controls the display unit to display the temperature data;

the measuring unit comprises a temperature sensing component and pins, the temperature sensing component is located at an outer wall of the outer shell of the electronic cigarette; the temperature sensing component is electrically connected with the circuit processing unit via the pins; the display unit is located within the outer shell of the electronic cigarette, and the outer shell correspondingly defines a display window; the display window is made of transparent or translucent material, or is an opening;

the electronic cigarette comprises a sucking rod and a power rod;

the thermometer module is installed in the electronic cigarette by means of a support bracket; the support bracket comprises an upper plate, a lower plate and a side plate connecting the upper plate and the lower plate, a receiving chamber is surrounded by the upper plate, the lower plate and the side plate; the display window is configured at the side plate;

the thermometer module is mounted at a bottom of the power rod; the power rod is provided at its bottom with a bottom cap which is connected with the lower plate of the support bracket; the bottom cap defines a through hole; the temperature sensing component is located at an outer side of the bottom cap, and the pins pass through the through hole and the lower plate of the support bracket and is fixed to the support bracket.

2. The electronic cigarette as described in claim 1, wherein, the thermometer module further comprises a thermometer circuit board, the circuit processing unit is integrated onto the thermometer circuit board; the thermometer circuit board and the display unit are stacked together, and an insulating heat shield is inserted therebetween.

3. The electronic cigarette as described in claim 1, further comprising an atomizer control circuit board disposed in the outer shell, wherein, the circuit processing unit is integrated onto the atomizer control circuit board.

4. The electronic cigarette as described in claim 1, wherein, the sucking rod comprises a sucking cylinder served as a part of the outer shell, an atomizing device disposed in the sucking cylinder, a liquid smoke cup, a sucking nozzle configured at an end of the sucking cylinder, and wherein the atomizing device comprises an atomizing cup having an atomizing chamber, at least two atomizers fixed in the atomizing chamber, and oil-guiding component for guiding the liquid smoke within the liquid smoke cup into the atomizing cup.

5. The electronic cigarette as described in claim 4, wherein, the sucking cylinder is further provided with a connecting element for fixing the atomizing device into the sucking cylinder, the connecting element has a cylindrical structure, and comprises an upper portion, a middle portion and a lower portion which are in turn increased in outer diameter, the upper portion of the connecting element is inserted into the bottom of the atomizing device and tightly fixed to the atomizing device to secure the atomizing device into the sucking cylinder, an outer wall of the lower portion of the connecting element is engaged with the inner wall of the sucking cylinder by expansion to fix the connecting element into the sucking cylinder.

6. The electronic cigarette as described in claim 4, wherein, the liquid smoke cup comprises a cup body having a hollow chamber, and a cup holder configured at a bottom of the cup body and hermetically connected with the cup body, the cup body and the sucking cylinder is integrally formed.

7. An electronic cigarette, comprising: an outer shell, and further comprising a thermometer module disposed on the outer shell; wherein, the thermometer module comprises a measuring unit, a display unit and a circuit processing unit; and the measuring unit gets a temperature data of an object to be measured or medium and transmits the temperature data to the circuit processing unit, and finally the circuit processing unit controls the display unit to display the temperature data;

the measuring unit comprises a temperature sensing component and pins, the temperature sensing component is located at an outer wall of the outer shell of the electronic cigarette; the temperature sensing component is electrically connected with the circuit processing unit via the pins; the display unit is located within the outer shell of the electronic cigarette, and the outer shell correspondingly defines a display window; the display window is made of transparent or translucent material, or is an opening;

the electronic cigarette comprises a sucking rod and a power rod; and the thermometer module is configured at the outer shell of the sucking rod and/or the power rod;

the sucking rod comprises a sucking cylinder served as the outer shell, an atomizing device disposed in the sucking cylinder, a liquid smoke cup, a sucking nozzle configured at an end of the sucking cylinder, and wherein the atomizing device comprises an atomizing cup having an atomizing chamber, at least two atomizers fixed in the atomizing chamber, and oil-guiding component for guiding the liquid smoke within the liquid smoke cup into the atomizing cup;

the sucking cylinder is further provided with a connecting element for fixing the atomizing device into the sucking cylinder, the connecting element has a cylindrical structure, and comprises an upper portion, a middle portion and a lower portion which are in turn increased in outer diameter, the upper portion of the connecting element is inserted into the bottom of the atomizing device and tightly fixed to the atomizing device to secure the atomizing device into the sucking cylinder, an outer wall of the lower portion of the connecting element is engaged with the inner wall of the sucking cylinder by expansion to fix the connecting element into the sucking cylinder;

wherein, the atomizers each comprises a heating wire for atomizing the liquid smoke and a fiber element for supporting the heating wire and adsorbing the liquid smoke; the atomizing cup comprises a cup holder, a cup cylinder sleeved around the cup holder and a lid covering the cup cylinder and opposing to the cup holder, and the cup holder, the cup cylinder and the lid cooperatively define the atomizing chamber; the atomizing chamber is further provided with a liquid storage element which is cylindrical and sleeved in the cup cylinder, the liquid storage element is provided with a cylindrical atomizer support therein for supporting and positioning the atomizers; the fiber element is fixed onto the atomizer support, and opposite ends thereof project out of a side wall of the atomizer support and abut against an inner wall of the liquid storage element, and the liquid smoke enters the atomizing chamber through the oil-guiding component and is adsorbed and stored in the liquid storage element and further infiltrated into the fiber element to be atomized.

8. The electronic cigarette as described in claim 7, wherein, the oil-guiding component is inverted Y-shaped, and comprises a head end and two tail ends, the head end of the oil-guiding component is inserted into the liquid smoke cup, and the two tail ends are extended into the atomizing chamber and respectively sandwiched between the inner wall of the liquid storage element and the outer wall of the atomizer support.

9. The electronic cigarette as described in claim 7, wherein, the atomizing device is sleeved around the connecting element by means of its cup cylinder so that the atomizing device is fixedly engaged with the connecting element to be secured into the sucking cylinder, a hermetical ring is configured between the inner wall of the sucking cylinder and the outer wall of the cup cylinder; the lower portion of the connecting element is provided with a flange radially outwardly extended from for positioning the sucking cylinder, inner threads for threadly engaging with the power rod, and intake holes.

10. An electronic cigarette device, comprising an electronic cigarette as described in claim 1, and further comprising an electronic cigarette casing, for accommodating the electronic cigarette.

11. The electronic cigarette device as described in claim 10, wherein, the electronic cigarette casing comprises a base box, a box cover covering the base box, and a thermometer module mounted to the base box or the box cover.

12. An electronic cigarette, comprising: an outer shell and a thermometer module installed in the electronic cigarette by means of a support bracket; wherein the support bracket is fitted with an inner wall of the outer shell of the electronic cigarette in shape; the thermometer module comprises a measuring unit, a display unit and a circuit processing unit; and the measuring unit gets a temperature data of an object to be measured or medium and transmits the temperature data to the circuit processing unit, and finally the circuit processing unit controls the display unit to display the temperature data; the measuring unit comprises a temperature sensing component and pins; the temperature sensing component is located at an outer wall of the outer shell of the electronic cigarette; the electronic cigarette comprises a power rod; the thermometer module is mounted at a bottom of the power rod; the power rod is provided at its bottom with a bottom cap which is connected with the support bracket; the bottom cap defines a through hole; the temperature sensing component is located at an outer side of the bottom cap, and the pins pass through the through hole and the support bracket and is fixed to the support bracket, and the temperature sensing component then is electrically connected to the circuit processing unit.

13. The electronic cigarette device as described in claim 12, wherein, the support bracket defines a receiving chamber by plates thereof for accommodating the display unit of the thermometer module; one plate defines pin holes, and the pins pass through the pin holes and then is electrically connected to the circuit processing unit.

14. The electronic cigarette device as described in claim 12, comprising a sucking rod, wherein the sucking rod comprises a sucking cylinder served as part of the outer shell, an atomizing device and a liquid smoke cup disposed in the sucking cylinder, and a sucking nozzle configured at an end of the sucking cylinder; liquid smoke is stored in the liquid smoke cup; the atomizing device comprises an atomizing cup, an atomizer, and an oil-guiding component guiding the liquid smoke from the liquid smoke cup into the atomizing cup for the atomizer to vaporize; the atomizing cup comprises a cup holder and a lid respectively disposed at each end of a cup cylinder, whereby cooperatively define an atomizing chamber; and the atomizer is fixed in the atomizing chamber and vaporizing the liquid smoke.

* * * * *